US010827794B2

(12) United States Patent
Votel et al.

(10) Patent No.: US 10,827,794 B2
(45) Date of Patent: Nov. 10, 2020

(54) WINTER HEADWEAR WITH BUMP CAP

(71) Applicant: Tenacious Holdings, Inc., St. Paul, MN (US)

(72) Inventors: Thomas Votel, Sunfish Lake, MN (US); Alsie Nelson, Woodbury, MN (US); Dominique Aris, Edina, MN (US)

(73) Assignee: Tenacious Holdings, Inc., St. Paul, MN (US)

( * ) Notice: Subject to any disclaimer, the term of this patent is extended or adjusted under 35 U.S.C. 154(b) by 0 days.

(21) Appl. No.: 16/119,981

(22) Filed: Aug. 31, 2018

(65) Prior Publication Data

US 2019/0090568 A1 Mar. 28, 2019

Related U.S. Application Data

(63) Continuation-in-part of application No. 29/619,071, filed on Sep. 26, 2017, now Pat. No. Des. 867,672.

(51) Int. Cl.

| | |
|---|---|
| ***A42B 1/08*** | (2006.01) |
| ***A42B 7/00*** | (2006.01) |
| ***A42B 3/08*** | (2006.01) |
| ***A42B 3/06*** | (2006.01) |
| ***A42B 1/06*** | (2006.01) |
| *A42B 3/00* | (2006.01) |

(52) U.S. Cl.

CPC ..... *A42B 1/08* (2013.01); *A42B 1/066* (2013.01); *A42B 3/06* (2013.01); *A42B 3/08* (2013.01); *A42B 7/00* (2013.01)

(58) Field of Classification Search

CPC .. A42B 3/127; A42B 1/08; A42B 3/12; A42B 3/125; A42B 3/121; A42B 3/00; A42B 3/06; A42B 3/10; A42B 3/28; A42B 3/322; A42B 3/128; A42B 3/32; A42B 3/04; A42B 1/069; A42B 1/201; A42B 3/0406; A42B 3/283

See application file for complete search history.

(56) References Cited

U.S. PATENT DOCUMENTS

| | | | | |
|---|---|---|---|---|
| D364,496 | S * | 11/1995 | Lejuez | D2/892 |
| 8,739,316 | B1 * | 6/2014 | Norton | A42B 1/08 2/411 |
| 9,364,039 | B2 * | 6/2016 | Pusateri | A42B 1/069 |
| 2004/0034903 | A1 * | 2/2004 | Blair | A42B 1/08 2/411 |
| 2004/0107482 | A1 * | 6/2004 | Picotte | A42B 1/08 2/411 |
| 2007/0130673 | A1 * | 6/2007 | Wasserkrug | A42B 1/08 2/411 |
| 2007/0245457 | A1 * | 10/2007 | Gelera | A42C 5/02 2/181 |
| 2010/0306904 | A1 * | 12/2010 | Neid | A42B 1/08 2/414 |
| 2019/0090568 | A1 * | 3/2019 | Votel | A42B 1/066 |

FOREIGN PATENT DOCUMENTS

| | | | | |
|---|---|---|---|---|
| WO | WO-2017006078 A1 * | 1/2017 | | A42B 1/08 |

* cited by examiner

*Primary Examiner* — Robert H Muromoto, Jr.
(74) *Attorney, Agent, or Firm* — Skaar Ulbrich Macari, P.A.

(57) ABSTRACT

A winter headwear having a selectively closable opening that is configured to accept a protective and removable bump cap. The bump cap is designed to be trimmable to accommodate headwear of various sizes and shapes.

15 Claims, 11 Drawing Sheets

WINTER HEADWEAR WITH BUMP CAP

CLAIM OF BENEFIT TO PRIOR APPLICATIONS

This application is a continuation-in-part of U.S. Design application No. 29/619,071 filed Sep. 26, 2017; and such application is hereby fully incorporated by reference herein.

FIELD

The present invention relates generally to protective headwear. More particularly, the present invention relates to a Bump Cap that can be removably inserted into cold weather headwear.

BACKGROUND

Bump Caps are useful for protecting the wearer's head from bumps, cuts and bruises as a result of contact with objects such as overhead pipes, low ceilings and other objects. They are most often worn under a personal hat, uniform cap, baseball hat or other non-protective headwear.

There are many different types of non-protective cold weather headwear, such as, for example, the watch cap, the trappers hat, the bomber hat, the fudd hat, and the balaclava hat, to name a few. Because a bump cap is many times required when the environmental conditions also require bulky headwear be worn to stay warm, there is a current and unfulfilled need to removably but securely combine the two articles. Further, because of the variable dimensions of these hats, there is a current and unfulfilled need for a Bump Cap that can be adjusted to accommodate the various hat dimensions.

SUMMARY

The invention provides a Bump Cap to be worn securely and removably in variety of cold weather hats, that can also be flexible to allow for horizontal variations in hat dimensions, and trimmable to allow for variation in the vertical variations in hat dimensions.

This summary is not intended to limit the scope of the invention, or describe each embodiment, implementation, feature or advantage of the invention.

DESCRIPTION OF THE PREFERRED EMBODIMENTS

It will be apparent to those skilled in the art, that is, to those who have knowledge or experience in this area of technology, which many uses and design variations are possible for the insertable, removable and adjustable Bump Cap disclosed herein. The following detailed discussion of the preferred embodiment will illustrate the general principles of the invention with reference to the disclosed Bump Cap. Other embodiments suitable for other applications will be apparent to those skilled in the art given the benefit of this disclosure.

The Bump Cap is preferably injection molded from a thermoplastic polymer such as polypropylene. Those skilled in the art will recognize that other rigid materials that have at least some flexibility may also be used, such as certain types of foam, etc. The Bump Cap invention disclosed herein is intended to be used in cold weather headwear. A low profile hidden zipper is incorporated into an upper portion of an article of cold weather headwear such that a user can put a bump cap inside the headwear to offer protection from bumps, cuts and bruises. This design allows for the bump cap to be hidden within the headwear such that its appearance is not altered by the presence of the bump cap. The zipper allows the shell to be easily removed for washing or for periods of time when the wearer is not engaged in activities that require the extra level of protection provided by the bump cap.

Figure 1:
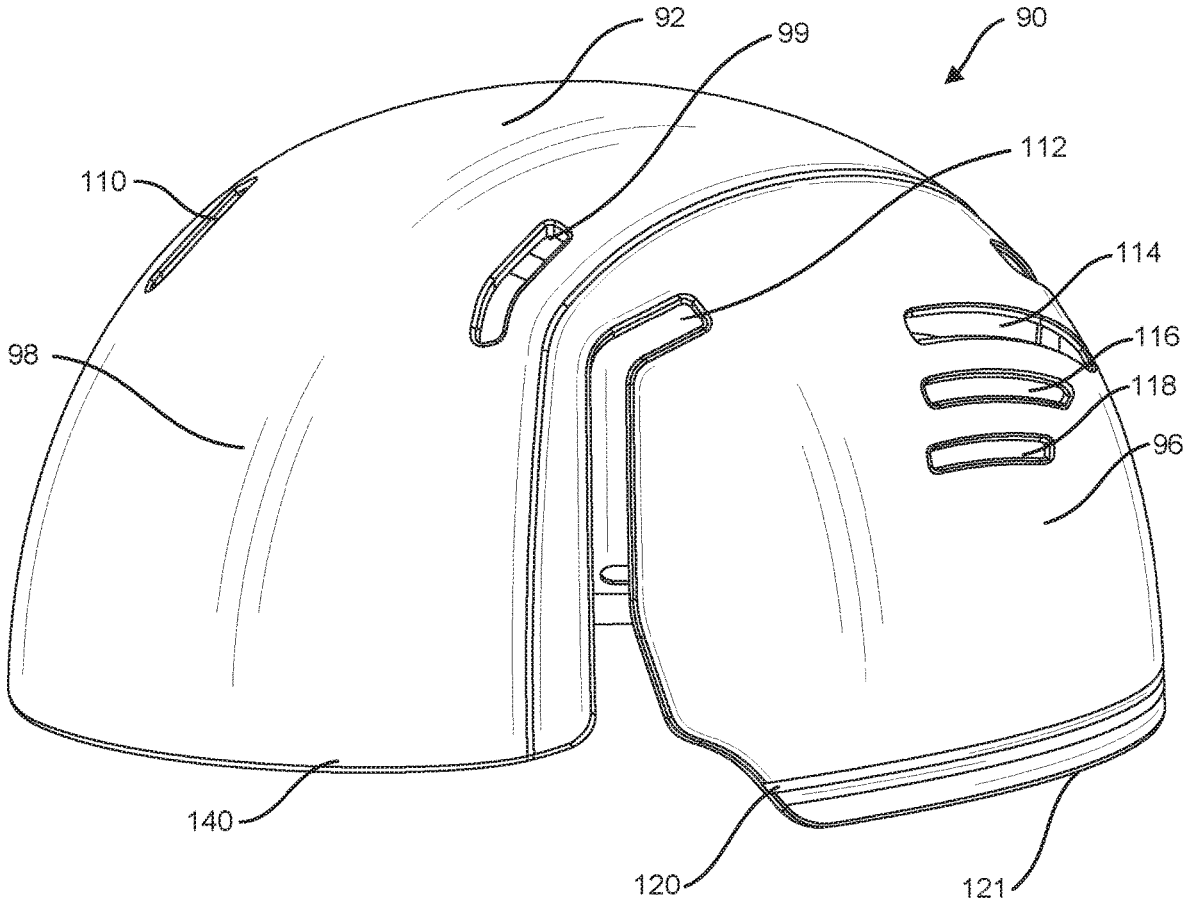
FIG. 1 is a front perspective view of a preferred embodiment of the invention.
Figure 2:
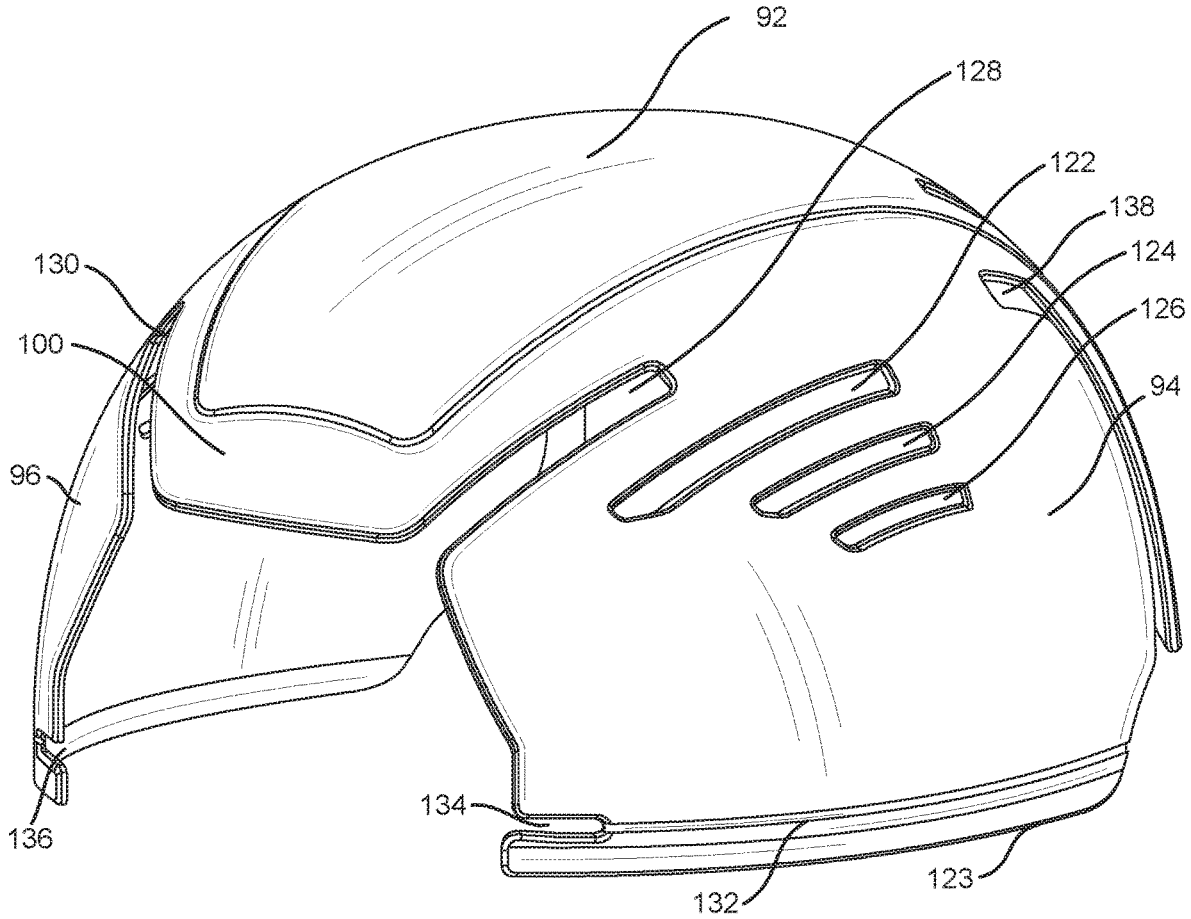
FIG. 2 is a rear perspective view of a preferred embodiment of the invention.
Figure 3:
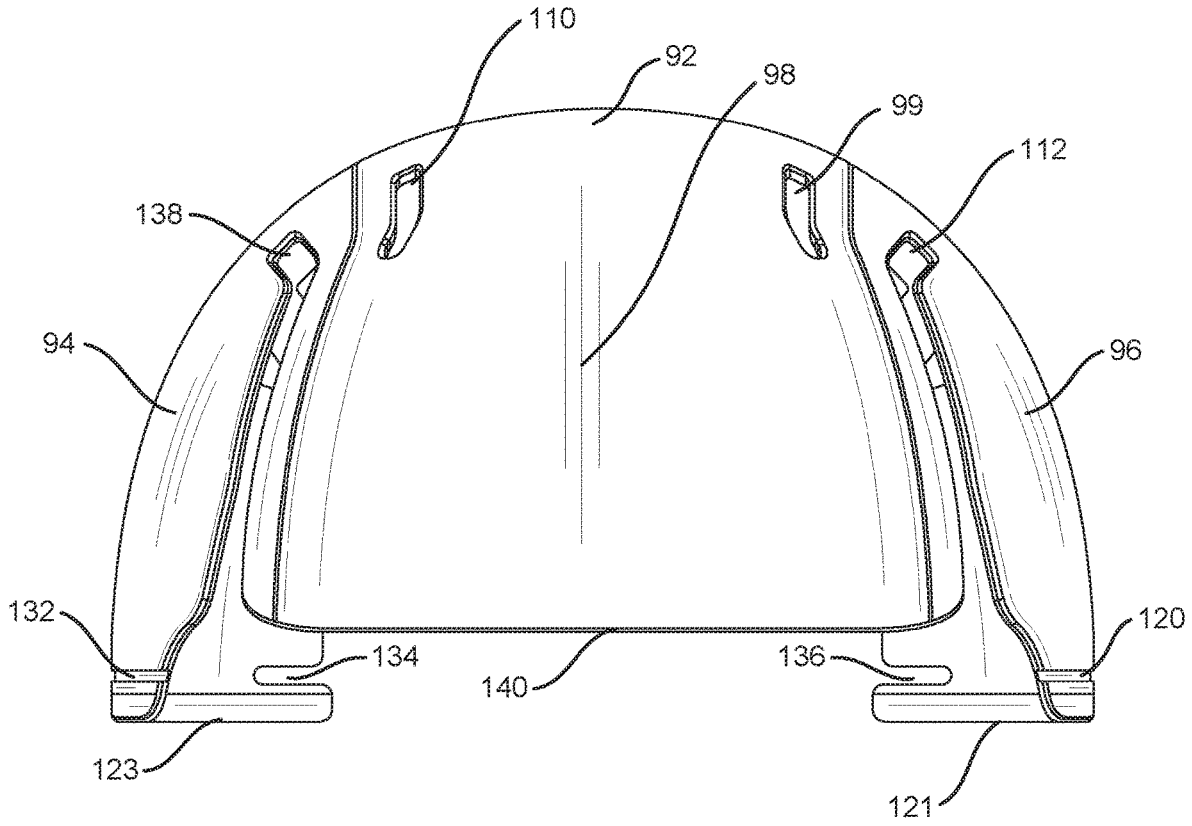
FIG. 3 is a front elevation of a preferred embodiment of the invention.
Figure 4:
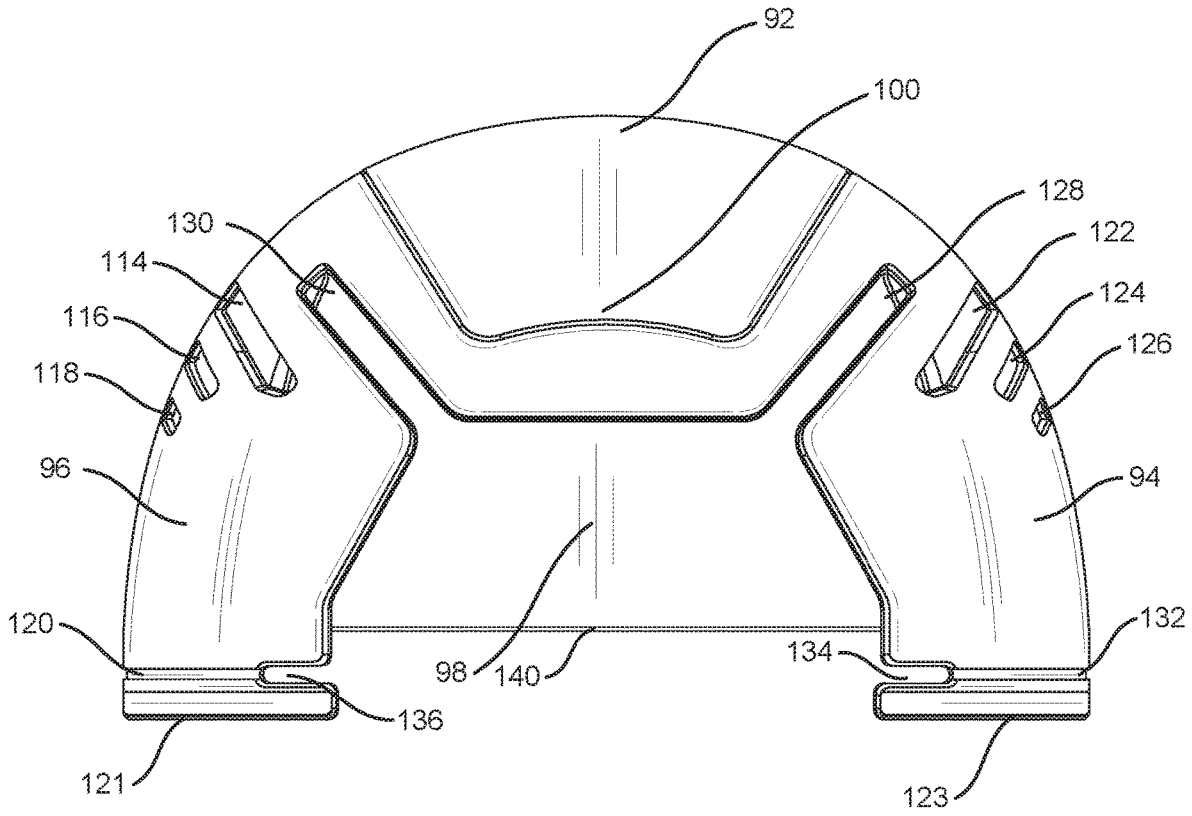
FIG. 4 is a rear elevation of a preferred embodiment of the invention.
Figure 5:
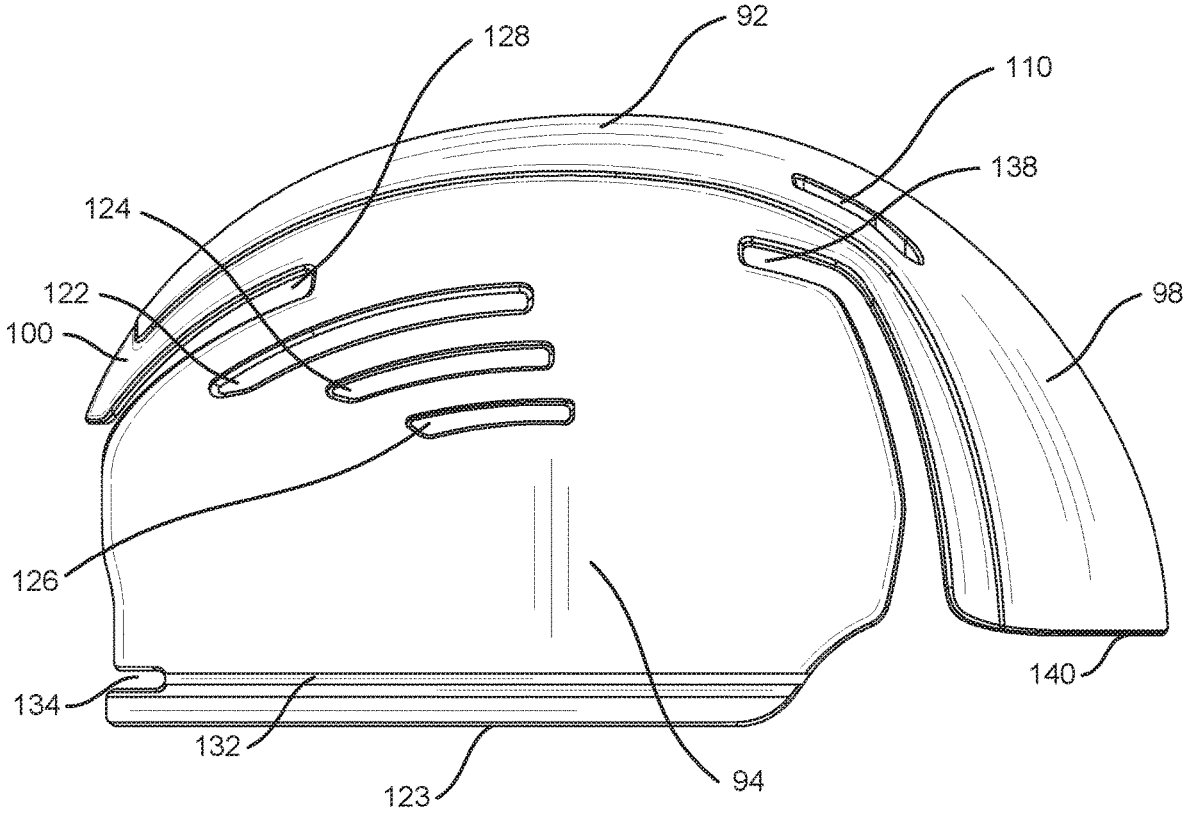
FIG. 5 is right side elevation view of a preferred embodiment of the invention.
Figure 6:
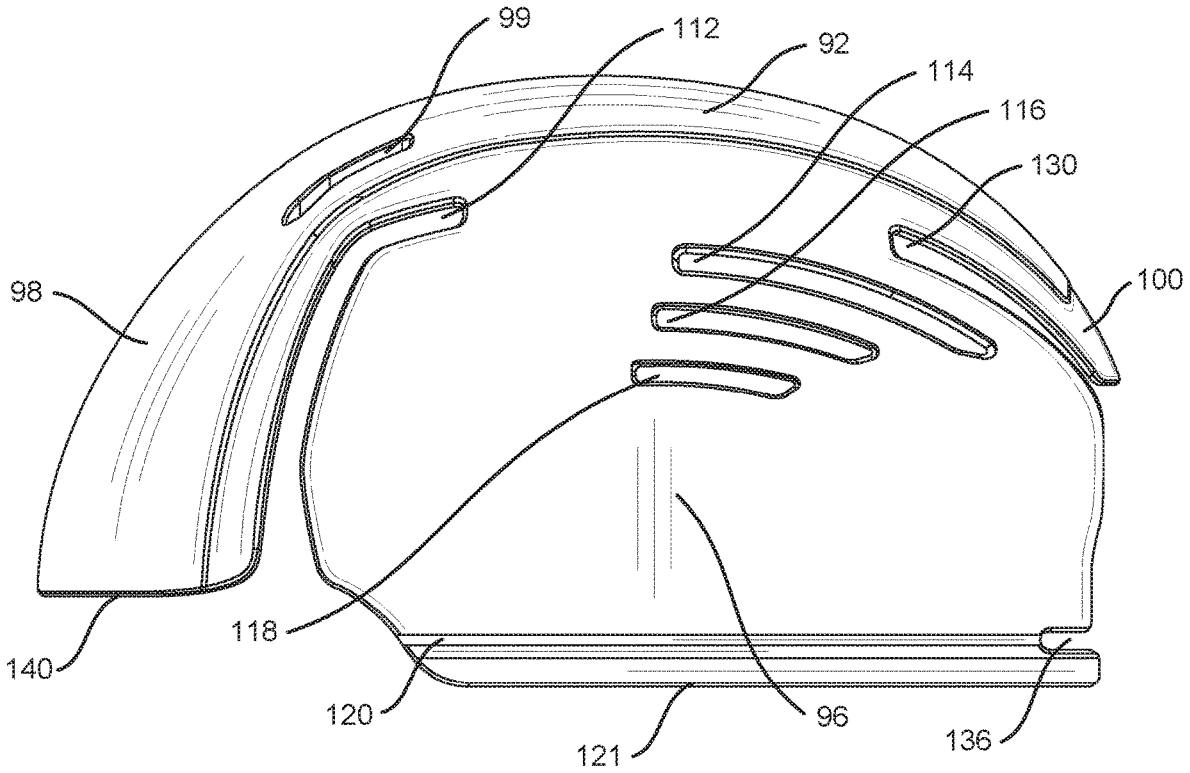
FIG. 6 is a left side elevation view of a preferred embodiment of the invention.
Figure 7:
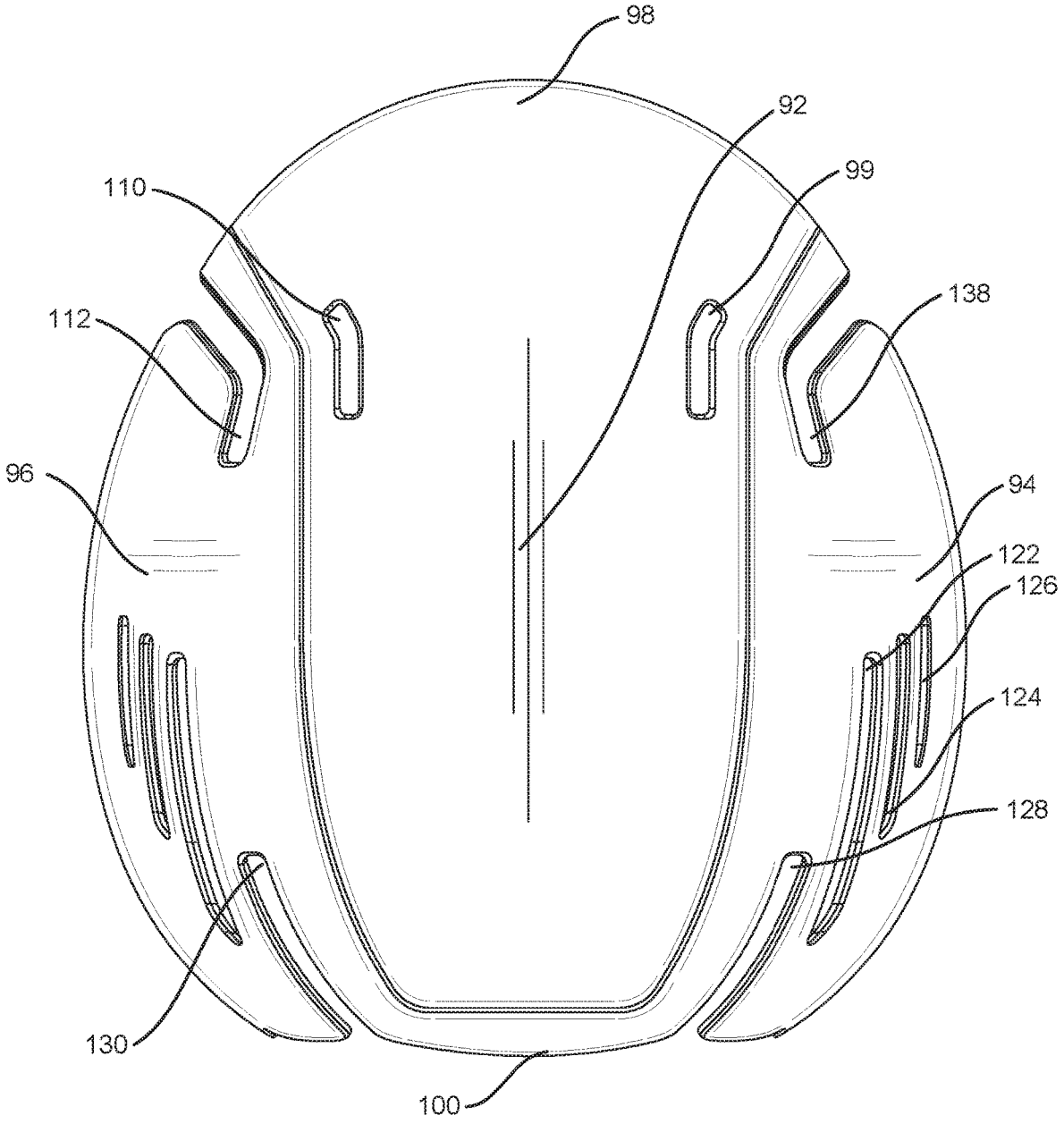
FIG. 7 is a top plan view of a preferred embodiment of the invention.

With reference to FIGS. 1-7, the various features of Bump Cap 90 are shown. Bump Cap 90 is comprised of crown 92 right side portion 94, left side portion 96, visor portion 98 and rear flap portion 100. Vents 114, 116 and 118 provide left side portion 96 ventilation, whereas vents 122, 124 and 126 provide right side portion 94 ventilation. Vents 110 and 99 provide crown 92 ventilation. One skilled in the art will understand that more or fewer vents may be required, and placement may be varied, according to environmental conditions or users' requirements.

Flex joints 138, 112, 128 and 130 allow Bump Cap 90 to flex when inserted into a hat to allow for variations in the hat's horizontal dimensions and to aide it securing Bump Cap 90 in place. Flex joints 138, 112, 128 and 130 also may supply additional ventilation.

Trim grooves 120 and 132 are located on the lower perimeter 121 of left side portion 96 and lower perimeter 123 on right side portion 94. Trim groove 120 runs horizontally along lower perimeter 121 on the left side portion 96. Trim groove 132 runs horizontally along lower perimeter 123 on right side portion 94. Trim grooves 120 and 132 allow sections of Bump Cap 90 to be removed by hand, box knife, scissors or other means. Removal of sections of Bump Cap 90 via trim grooves 120 and 132 allow the vertical dimensions of Bump Cap 90 to be adjusted so as to remain secure and hidden under a user's hat. One skilled in the art will appreciate that more than one trim groove may be incorporated into Bump Cap 90 to allow for greater vertical dimension adjustment.

Trim notches 134 and 136 assist the user in removing a portion of Bump Cap 90 at the trim groves 120 and 132.

More trim notches may be used to accommodate a greater number of trim grooves. Trim grooves and respective trim notches may also be incorporated into leading edge 140 of visor portion 98 to allow for the vertical adjustment of visor portion 98 (grooves not shown).

Figure 8:
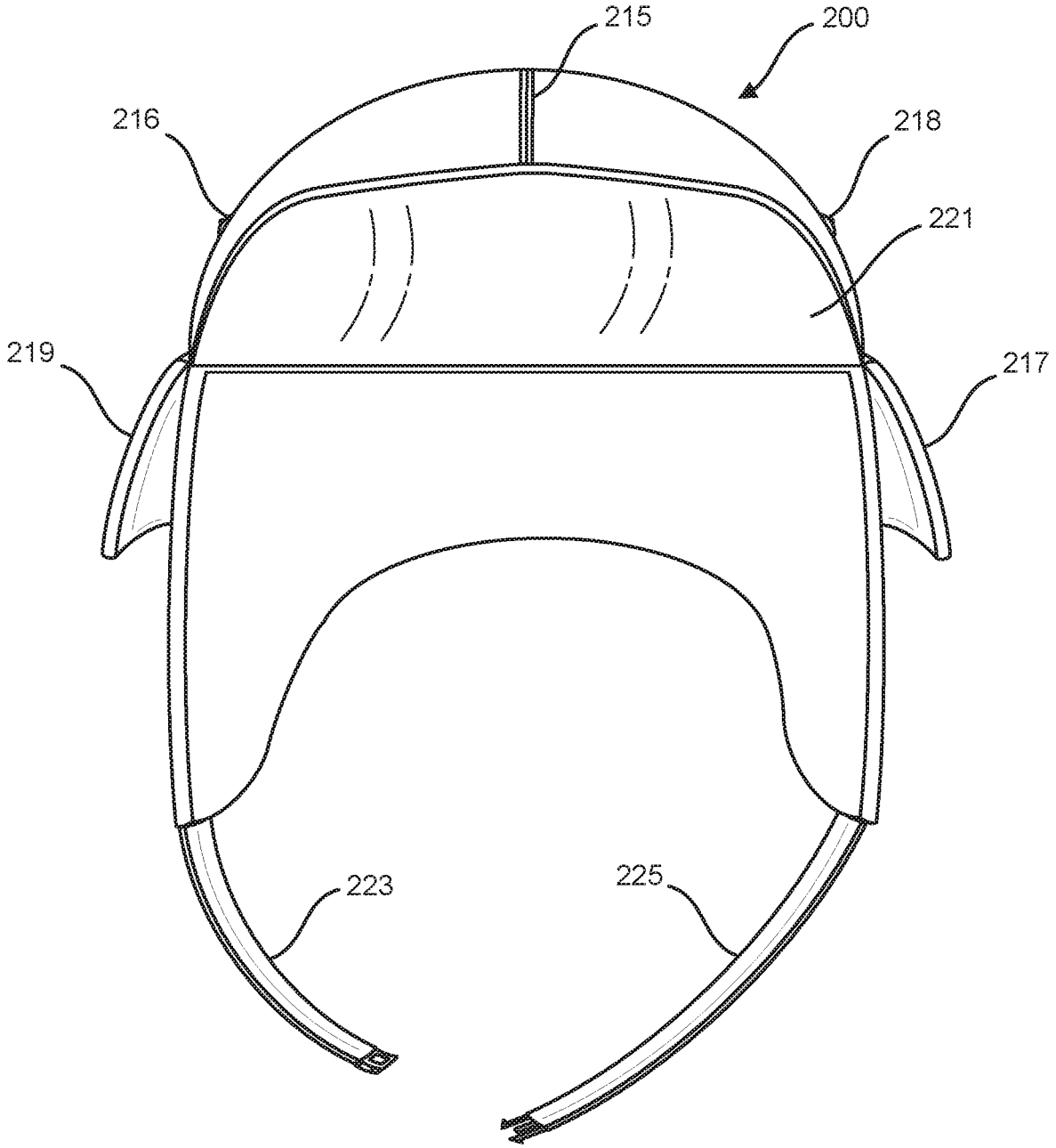
FIG. 8 is front elevation view showing exemplary winter headwear with the covered zipper closed.
Figure 9:
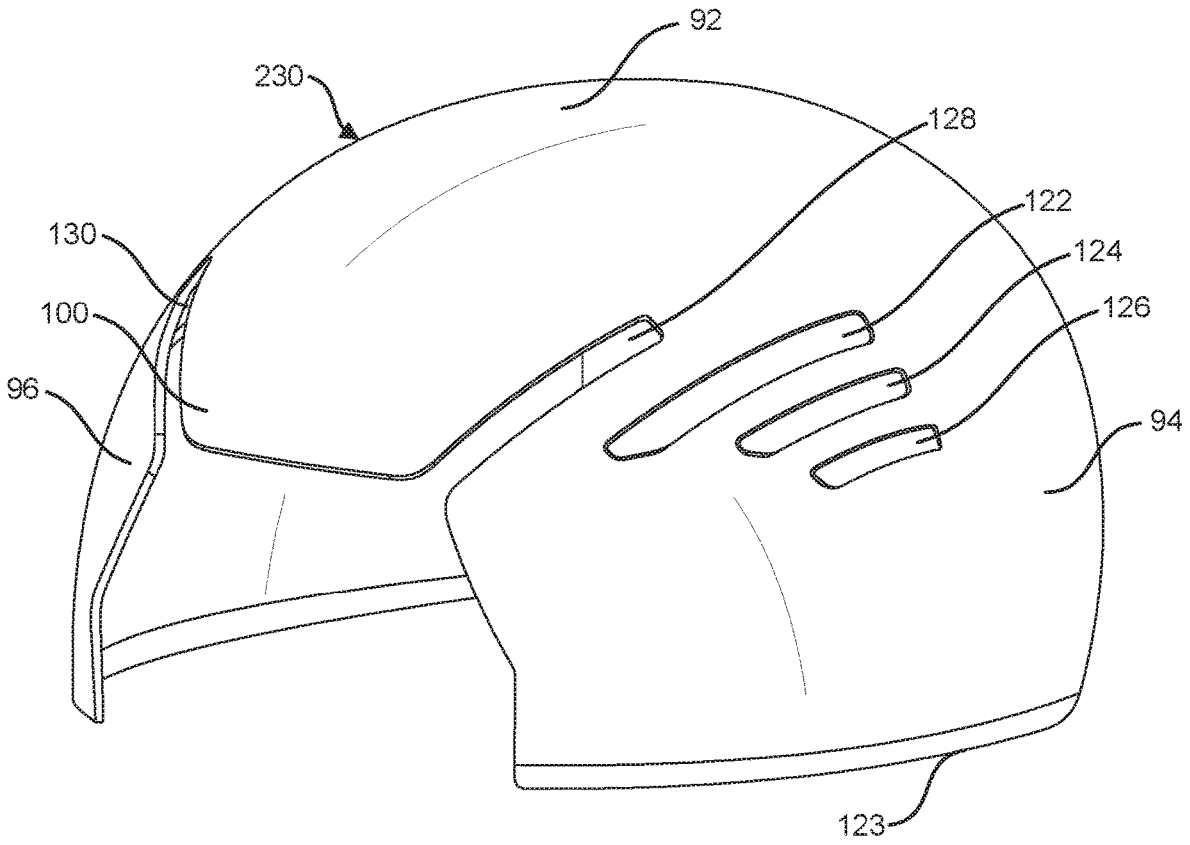
FIG. 9 is a perspective view of a bump cap that is insertable into winter headwear.
Figure 10:
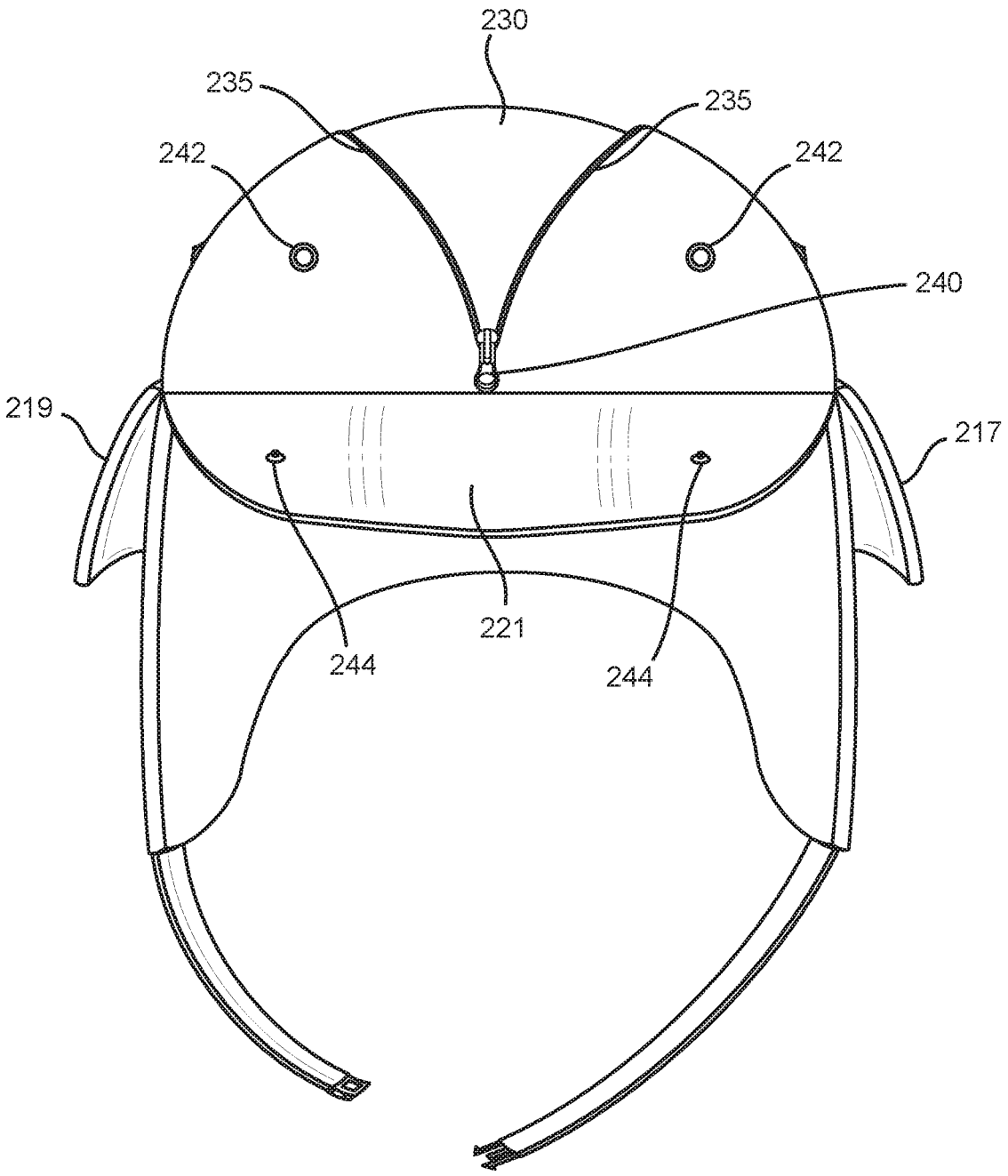
FIG. 10 is a front elevation view of exemplary winter headwear with the zipper in the open position revealing the insertable bump cap.
Figure 11:
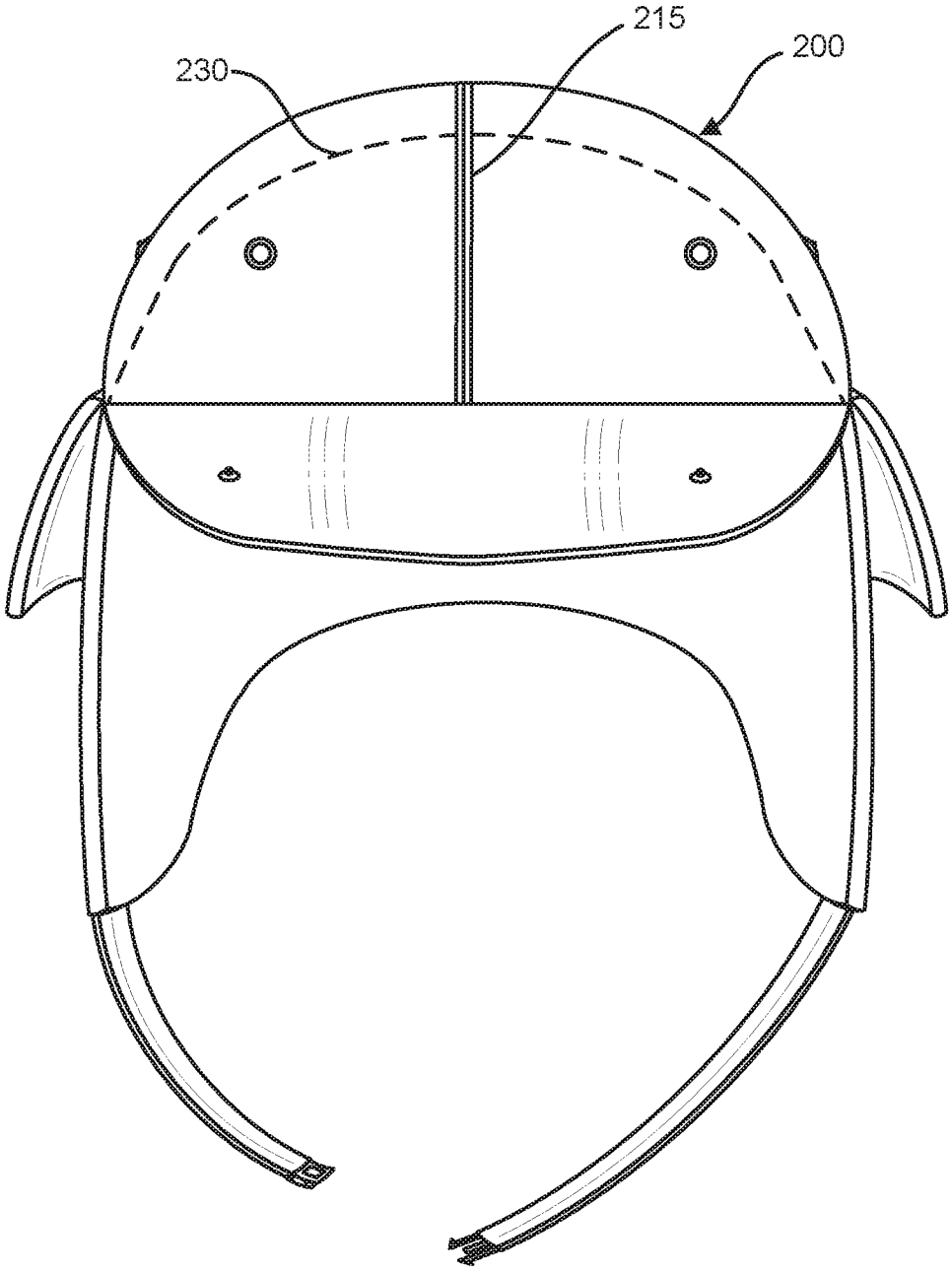
FIG. 11 is a front elevation view of exemplary winter headwear with the covered zipper in the closed position and the insertable bump cap shown in dashed lines.

With reference to FIGS. 8-11, an exemplary trapper's hat is disclosed configured for an insertable bump cap. Flapped seam 215 covers zipper 235 of trapper's hat 200. The trapper's hat comprises visor flap 221, ear flaps 217 and 219, ear flap retainers 216 and 218 and chin straps 223 and 225. As can be best seen in FIG. 10, visor flap 221 folds down to reveal zipper pull 240. Visor flap 221 is retained by snaps 244 and 242 in an up position. Zipper 235 is open by pulling zipper pull 240 to release zipper 235. The opening left by releasing zipper 235 is configure to allow for bump cap 230 or bump cap 90 to be inserted between the trapper's hat outer shell 232 and an second inner layer 234, which is preferably an insulated headliner (not shown). If bump cap 90 is inserted into trapper's hat 200, it can be adjusted for the best fit as previously described. Zipper pull 240 is then used to close zipper 235, thereby concealing exemplary bump cap 230 or 90.

It is contemplated that the same hat construction can be used on other types of cold weather headwear such as a watch hat, a fudd hat, a balaclava or other types of winter headwear. It is also contemplated that zipper 234 can be replace by other closures known by those of ordinary skill in the art, such as hook and loop, buttons or other means.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. Winter headwear with insertable bump cap comprising:

an item of winter headwear comprising a crown portion having a first layer and a second layer defining an interior therebetween;

an access section located on the first layer of the crown portion of the winter headwear, the access section having an access opening defining selectively separable first layer portions that have an open position and a closed position;

the first layer of the winter headwear crown portion being laid open in its open position;

a bump cap sized such that it can be inserted into the access opening between the first layer portions of the crown portion when the access section is in its open position;

the bump cap further being sized and configured to allow the bump cap to remain in the interior when the access opening is in its closed position;

the bump cap comprising a skull shaped shell having a rigid outer surface; and the skull shaped shell being sized to fit over a skull of a wearer of the winter headwear;

wherein the rigid outer surface of the bump cap defines at least two vent openings.

2. The winter headwear with insertable bump cap of claim 1 wherein the access section is a zipper.

3. The winter headwear with insertable bump cap of claim 1 wherein the at least two vent openings are located on a left side portion and a right side portion of the rigid outer shell of the bump cap.

4. The winter headwear with insertable bump cap of claim 1 wherein a trim groove extends about a portion of the bump cap, to allow for removal of a portion of the bump cap shell, the trim groove being located proximate to a lower perimeter edge of the bump cap.

5. A method of inserting a bump cap into winter headwear, the method comprising:

providing a winter headwear having a front facing portion and a rear facing portion, the winter headwear comprising a crown portion having a first layer and a second layer defining an interior therebetween, the first layer having an access opening with a zipper that defines selectively separable first layer portions having an open position and a closed position;

inserting a skull shaped bump cap that has a rigid outer surface, a front portion and a rear portion, into the access opening between the first layer portions of the crown;

orienting the skull shaped bump cap such that the front portion of the skull shaped bump cap is aligned with the front portion of the item of winter headwear; and closing the zipper such that the entirety of the skull shaped bump cap is enclosed and under the first layer of the crown of the item of winter headwear.

6. The method of claim 4 further comprising:

trimming a lower perimeter section of the skull shaped bump cap on a trim groove to alter the shape of the skull shaped bump cap.

7. A winter headwear with removable bump cap system comprising:

an item of winter headwear comprising at least a crown portion having a first layer and a second layer defining an interior therebetween, the first layer having a selectively closable access opening to the interior, the access opening defining selectively separable first layer portions; and a removable bump cap removably insertable between the first layer portions and positionable in the interior between the first layer and second layer.

8. The winter headwear with removable bump cap system of claim 7 further comprising a zipper operatively coupled to the first layer portions to permit an opening and closing of the access opening.

9. The winter headwear with removable bump cap system of claim 7, wherein the bump cap further comprises at least one flex joint formed therein to permit flexing of at least a portion of the bump camp.

10. The winter headwear with removable bump cap system of claim 7, wherein the bump cap further comprises at least one trim notch formed into a perimeter edge of the bump cap to permit trimming of at least a portion of the bump camp.

11. The winter headwear with removable bump cap system of claim 8, wherein the at least one trim notch is aligned with at least one trim groove formed in a portion of an outer surface of the bump cap to guide a trimming of a portion of the bump camp.

12. The winter headwear with removable bump cap system of claim 7, wherein the bump cap comprises a rigid material.

13. The winter headwear with removable bump cap system of claim 7, wherein the bump cap comprises a semi-rigid material.

14. The winter headwear with removable bump cap system of claim 7, wherein the bump cap comprises a skull shaped shell having a rigid outer surface.

15. The winter headwear with removable bump cap system of claim 7, further comprising at least one trim groove formed in an outer surface of the bump cap to guide a trimming of a portion of the bump camp, the trim groove having a thickness less than a thickness of the bump cap.

* * * * *